US006689022B1

(12) United States Patent
Emick

(10) Patent No.: US 6,689,022 B1
(45) Date of Patent: Feb. 10, 2004

(54) WEIGHT PLATE LIFTING APPARATUS WITH SINGLE HANDLE

(76) Inventor: Daniel W. Emick, 4882 Rte. 87 Hwy., Williamsport, PA (US) 17701

( * ) Notice: Subject to any disclaimer, the term of this patent is extended or adjusted under 35 U.S.C. 154(b) by 0 days.

(21) Appl. No.: 10/406,724

(22) Filed: Apr. 3, 2003

(51) Int. Cl.[7] ..... A63B 21/06
(52) U.S. Cl. ..... 482/93; 482/94; 482/98
(58) Field of Search ..... 482/93, 94, 98; D21/684, 662, 694, 679, 677, 681, 683

(56) References Cited

U.S. PATENT DOCUMENTS 4,109,908 A * 8/1978 Pugh et al. ..... 482/93
5,284,458 A * 2/1994 Perry et al. ..... 482/49
D416,959 S * 11/1999 Tumminia ..... D21/662

OTHER PUBLICATIONS

Kamparts, Inc. Catalog Page.

* cited by examiner

*Primary Examiner*—Jerome W. Donnelly
(74) *Attorney, Agent, or Firm*—Thomas R. Shaffer, Esq.

(57) ABSTRACT

A weight plate lifting apparatus includes base member, an upright member attached to the base, a generally horizontal weight plate arm member attached to the upright member and a handle member attached to an upper portion of the upright member. The device allows the user to lift a desired number of weight plates by providing a handle at a location vertically above the weight plates thus reducing the distance toward the floor the user must bend.

17 Claims, 4 Drawing Sheets

WEIGHT PLATE LIFTING APPARATUS WITH SINGLE HANDLE

BACKGROUND OF THE INVENTION

1. Field of the Invention

The present invention relates to a weight plate lifting apparatus with a single handle. More specifically, it relates to such a lifting apparatus which allows the user to lift a desired number of weight plates by providing a handle at a location vertically above the weight plates thus reducing the distance toward the floor the user must bend.

2. Prior Art

While the present invention may be utilized for other exercises, it is particularly useful and is particularly designed for performing "shrugs" exercise. Shrugs exercise is a popular movement used to strengthen the trapezoid muscles located between ones shoulders and neck. To perform this movement, the user grasps bar/dumbbell or machine handles with arms hanging down at one's sides. The user then "shrugs", moving one's shoulders as if attempting to touch one's ears with the shoulders. Upon reaching the "top" of the movement, the user lowers the shoulders to the start position and repeats until completion of a training "set".

Performance of shrugs has heretofore typically employed common barbells and dumbbells as resistance. Both are considered fairly effective. However, barbells tend to rub on any anterior protrusions causing discomfort and distraction. Dumbbells at 8" wide can also prove cumbersome inflicting added friction resistance and rubbing contact with thighs. To escape these annoyances, users often lean forward which does serve to give space, but also places the lower back at risk due to leverage disadvantages of holding heavy dumbbells away from the body. Dumbbells can also prove very dangerous and difficult to rerack during a state of temporary muscle exhaustion.

Existing devices also consist of various specialty one-piece bars and machines with handles which remove the rubbing and racking dangers associated with dumbbells. However, such machines also removes the "all-plane" of motion training effect inherent to free weight devices. Additionally, none afford the user the freedom of movement and range of motion advantages inherent to separate individual dumbbells.

SUMMARY OF THE INVENTION

The present invention gives lifters the ability to enjoy free weight benefits, freedom of movement and range of movement advantages innate to dumbbells without the unwelcome contact and dangerous racking dilemma's. The present invention preferably provides separate hand held units, featuring free standing bases, vertically adjustable spinning handles and hang-free design which alleviates body contact while simultaneously allowing the user to remain erect in the safety zone of correct lift posture.

In use, one simply loads weight plates onto the apparatus, adjusts the handles to desired height and commences "shrugging". When the set is complete, the user bends one's knees slightly while remaining erect, landing weight on free standing base and walks away.

The present invention includes, in its simplest form, a base member; an upright member attached to said base; a generally horizontal weight plate arm member attached to said upright member and extending outwardly therefrom in a first direction; and a handle member attached to an upper portion of said upright member.

The base member is a horizontally oriented planar member which rests upon a supporting surface and is preferably formed of metal. Preferably, the base member extends away from said upright member in said first direction but not in an opposite direction thereto and is narrow at an end where said plate member is attached to said upright member and becomes wider at locations spaced therefrom more distant therefrom.

The upright member preferably has a hole therein at a plurality of different vertical locations thereon. Further, the upright member preferably has a generally square cross-sectional configuration.

The arm member preferably further comprises a weight plate stop member and a weight plate clamp member. In the preferred embodiment, said arm member further comprises a plurality of spaced apart recesses adapted to receive at least a portion of said weight plate clamp member when said clamp member is attached to said arm member. The arm member is adapted to receive and secure a desired number of weight plates to allow lifting thereof by said handle member.

The handle member preferably further comprises a lower end portion which telescopically attaches to said upright member. The lower end portion of said handle member preferably encircles an upper end portion of said upright member and is vertically slidable thereon. The handle member further includes a handle locking member which secures said handle to said upright member in one of a plurality of vertical positions on said upright member. Preferably, the handle locking member secures said handle to said upright member in one of a plurality of holes provided at different vertical locations on said upright member.

In one embodiment of the present invention, said handle member includes a handle grip bar oriented along a line which is transverse to a plane in which said upright member and said arm member are situate. Preferably, said handle member has an outer grip tube which is rotatable with respect to said handle grip bar. Preferably, said handle member includes a grip tube to which a layer of foam material is attached.

DETAILED DESCRIPTION OF THE PREFERRED EMBODIMENTS

Figure 1:
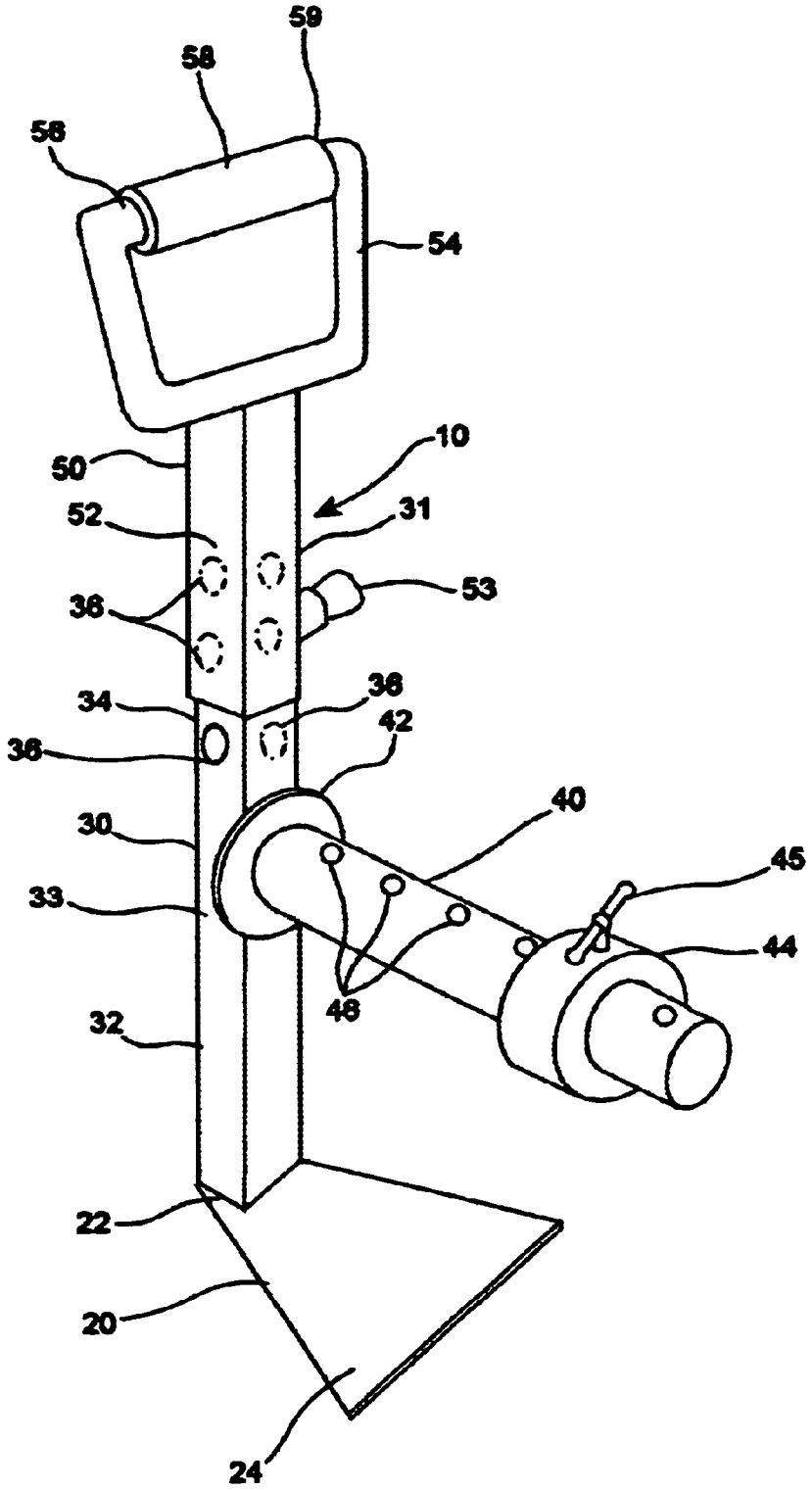
FIG. 1 is an isometric view of the lifting apparatus of the present invention.

Referring to the figures, the present invention provides for a weight plate lifting apparatus which is designated 10 in the figures, weight plate lifting apparatus 10 includes a base member 20 which includes a narrow end 22 and a wider end 24. Attached to the base plate 20 is an upright member 30. Upright member 30 has a lower end 32 and an upper end 34. A plurality of holes 36 are provided in at least side 31 of the upright member 30 for a reason which will be hereinafter explained. Although not necessary and not preferred holes may also be placed in side 33 of upright member 31 as shown.

The weight plate lifting apparatus 10 also includes an arm member 40 which includes a weight plate stop member 42 as well as a clamp ring member 44 which has a screw 45 therein which is adapted to engage the arm member 40 to hold the clamp ring 44 in position. Alternatively, although not preferred, the screw 45 may be received in one of a plurality of holes 46 which may, if desired, be provided in arm member 40.

The weight plate lifting apparatus 10 also includes a handle member 50 which includes a lower portion 52 and a handle member 54. As can be best seen in FIG. 1, the lower portion 52 of the handle member 50 is sized and configured to telescope over an upper end 34 of upright member 30. A popper 53 is utilized to secure handle member 50 in a desired vertical location by inserting a pin into one of the vertically spaced holes 36 provided on the upright member 30. The popper 53 thus provides a handle locking member. A handle 54 includes a handle grip bar 56 over which a handle grip tube 58 may be rotatably positioned. Thus, tube 58 rotates relative to the handle grip bar 56. If desired, a layer 59 of foam material or dense rubber 59 may be placed over the grip tube 58.

Figure 2:
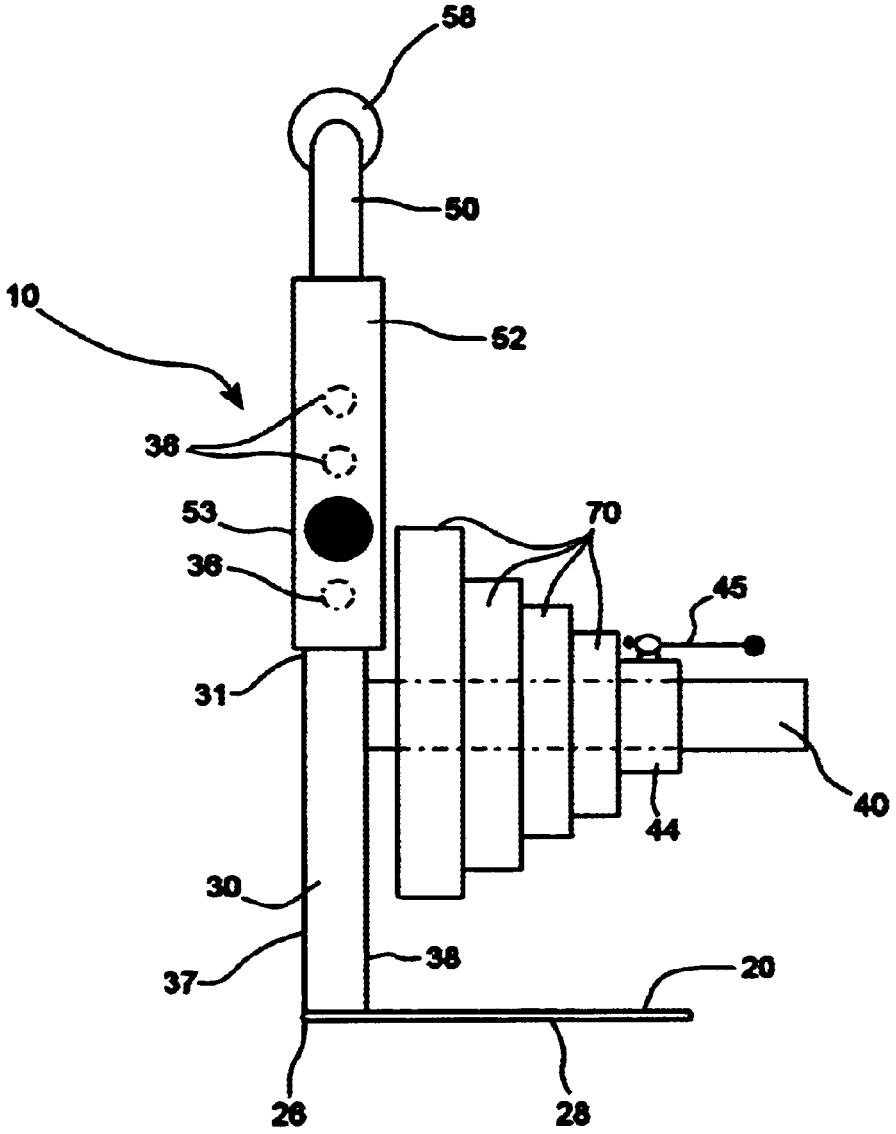
FIG. 2 is a side elevation view of the lifting apparatus of the present invention with weight plates attached.
Figure 3:
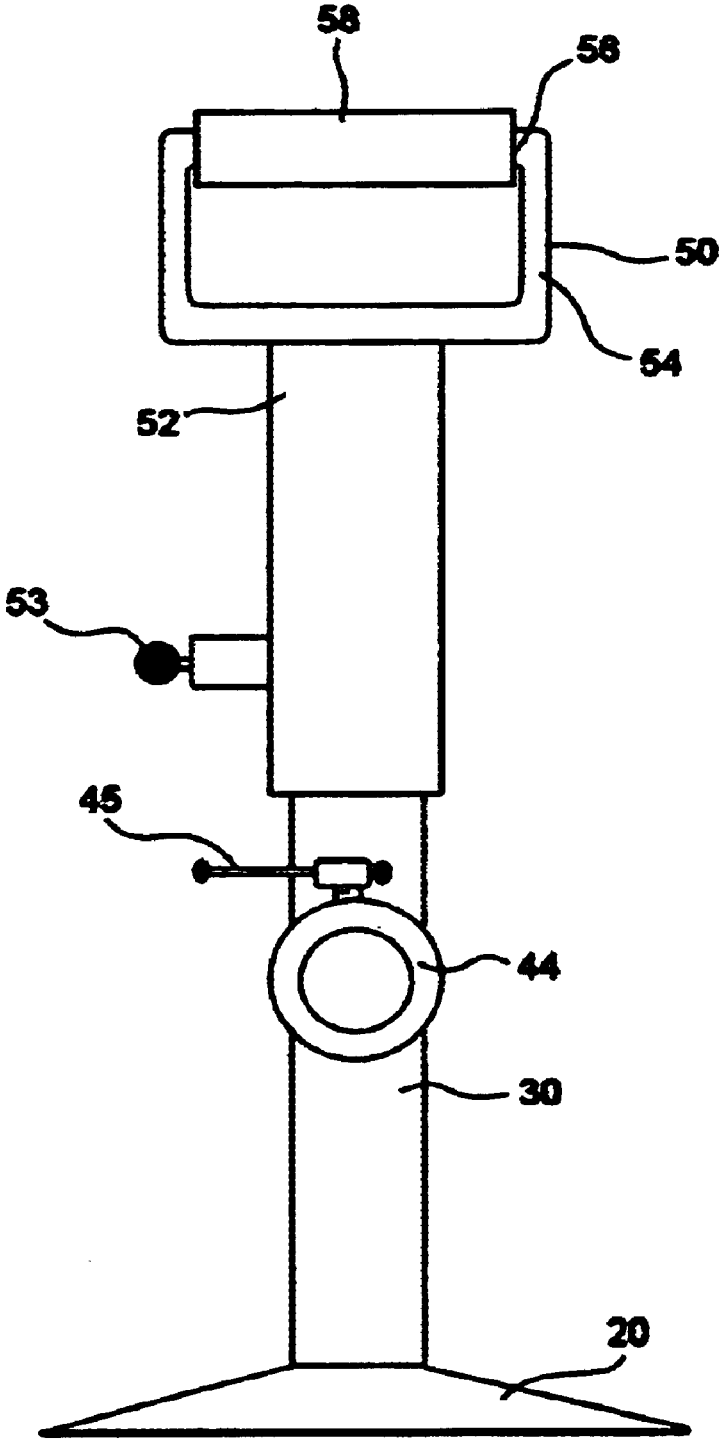
FIG. 3 is a front elevational view of the lifting apparatus of the present invention.

Referring to FIG. 2, the arm member 40 is adapted to receive a plurality of weight plates 70 as shown. The clamp member 44, 45 is utilized to hold the weight plates 70 in position on the arm member 40. Any number of weight plates 70 may be utilized to make the shrug exercise as easy or as difficult as desired.

Figure 4:
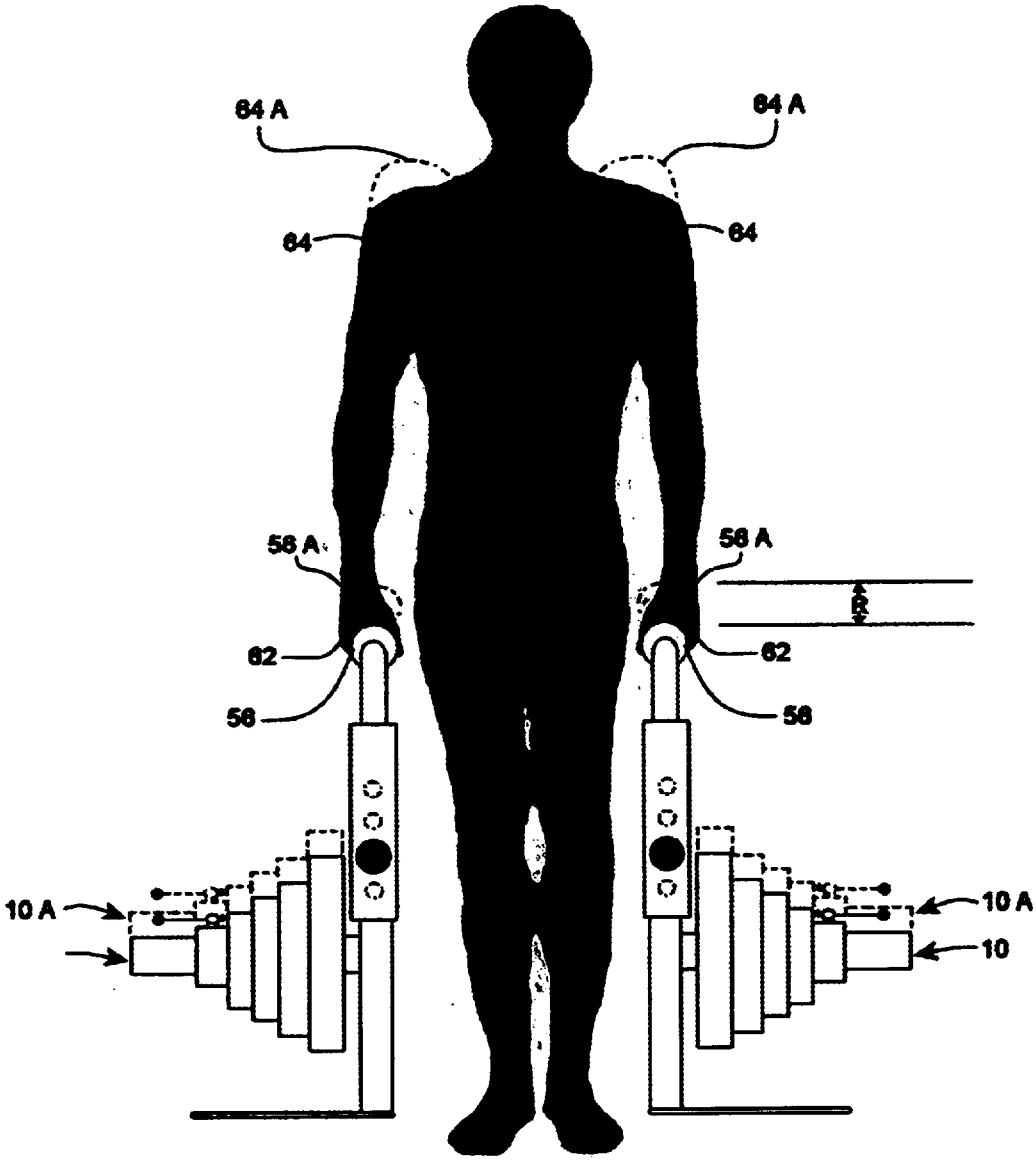
FIG. 4 is a front view of a user holding two lifting devices of the present invention and illustrating a shrug exercise.

Referring now to FIG. 4, a user 60 is shown having a weight plate lifting apparatus 10 in each hand 62. The user 60 starts the shrug exercise with his hands 62 by his sides. By shrugging his shoulders 64 to the position by chain line 64A, both weight plate lifting devices 10 move to position 10A as shown in chain line. Thus, the handle grip bar 56 moves to handle bar grip position 56A moving a distance R. This distance "R" is the proper range of motion for the device during a typical shrug exercise.

It will be obvious that by making the appropriate vertical adjustment of the handle member 50 relative to the upright member 30, the user can avoid having to bend over a significant distance to initially pick up the weight plate lifting devices 10. Thus, unnecessary back strain is eliminated. Also as shown in FIG. 4, because of the arrangement and configuration of the various components of the present invention, weight plates can be effectively lifted during a shrug exercise without any contact with the weight members along the anterior portions of the users body.

The invention having been disclosed in connection with the foregoing variations and examples, additional variations will now be apparent to persons skilled in the art. The invention is not intended to be limited to the variations specifically mentioned and accordingly reference should be made to the appended claims rather than the foregoing discussion of preferred examples to assess the scope of the invention in which exclusive rights are claimed.

I claim:

1. A weight plate lifting apparatus comprising:

a base member having a perimeter portion and a central portion, said base member being in the form of a horizontally oriented planar member which rests upon a supporting surface;

an upright member attached to said base, said upright member having a user side and having a weight side and said upright member being attached to said base at a location on said perimeter portion of said base with said user side facing said perimeter portion and said weight portion facing said central portion of said base member;

a generally horizontal weight plate arm member attached to said upright member, said arm member extending outwardly from said upright member in a first direction but not in an opposite direction whereby said arm member and said base member are spaced apart and generally parallel to one another and said arm member passes over said central portion of said base member, said base member also extending away from said upright member in said first direction but not in an opposite direction, whereby neither said base member nor said arm member extends outwardly in the direction of said user side; and a handle member attached to an upper portion of said upright member.

2. A weight plate lifting apparatus according to claim 1 wherein said base member is formed of metal.

3. A weight plate lifting apparatus comprising:

a base member;

an upright member attached to said base;

a generally horizontal weight plate arm member attached to said upright member and extending outwardly therefrom in a first direction; and a handle member attached to an upper portion of said upright member;

wherein said base member is a horizontally oriented planar member which rests upon a supporting surface, wherein said base member extends away from said upright member in said first direction but not in an opposite direction thereto and wherein said base member is narrow at an end where said planar member is attached to said upright member and becomes wider at locations spaced therefrom more distant therefrom.

4. A weight plate lifting apparatus according to claim 1 wherein said upright member has a hole therein at a plurality of different vertical locations thereon.

5. A weight plate lifting apparatus according to claim 1 wherein said upright member has a generally square cross-sectional configuration.

6. A weight plate lifting apparatus according to claim 1 wherein said arm member further comprises a weight plate stop member.

7. A weight plate lifting apparatus according to claim 1 wherein said arm member further comprises a weight plate clamp member.

8. A weight plate lifting apparatus according to claim 7 wherein said arm member further comprises a plurality of spaced apart recesses adapted to receive at least a portion of said weight plate clamp member when said clamp member is attached to said arm member.

9. A weight plate lifting apparatus according to claim 1 wherein said arm member is adapted to receive and secure a desired number of weight plates to allow lifting thereof by said handle member.

10. A weight plate lifting apparatus according to claim 1 wherein said handle member further comprises a lower end portion which telescopically attaches to said upright member.

11. A weight plate lifting apparatus according to claim 10 wherein said lower end portion of said handle member encircles an upper end portion of said upright member and is vertically slidable thereon.

12. A weight plate lifting apparatus according to claim 1 wherein said handle member further includes a handle locking member.

13. A weight plate lifting apparatus according to claim 12 wherein said handle locking member secures said handle to said upright member in one of a plurality of vertical positions on said upright member.

14. A weight plate lifting apparatus according to claim 12 wherein said handle locking member secures said handle to said upright member in one of a plurality of holes provided at different vertical locations on said upright member.

15. A weight plate lifting apparatus according to claim 1 wherein said handle member includes a handle grip bar oriented along a line which is transverse to a plane in which said upright member and said arm member are situate.

16. A weight plate lifting apparatus according to claim 1 wherein said handle member further comprises an outer grip tube which is rotatable with respect to a handle grip bar.

17. A weight plate lifting apparatus according to claim 1 wherein said handle member has a handle grip tube to which a layer of foam material or dense rubber is attached.

* * * * *

UNITED STATES PATENT AND TRADEMARK OFFICE

CERTIFICATE OF CORRECTION

PATENT NO. : 6,689,022 B1
DATED : February 10, 2004
INVENTOR(S) : Daniel W. Emick It is certified that error appears in the above-identified patent and that said Letters Patent is hereby corrected as shown below:

Column 3,
Line 27, insert -- Still referring to Figure 2, the upright member 30 has a user side 37 and the weight side 38. Further, the base member 20 has a perimeter portion 26 and the central portion 28. --

Signed and Sealed this

First Day of June, 2004

JON W. DUDAS
*Acting Director of the United States Patent and Trademark Office*